US009135823B2

(12) United States Patent
Takaki

(10) Patent No.: US 9,135,823 B2
(45) Date of Patent: Sep. 15, 2015

(54) OBJECT TYPE DETERMINATION APPARATUS

(71) Applicant: DENSO CORPORATION, Kariya, Aichi-pref (JP)

(72) Inventor: Ryo Takaki, Okazaki (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/080,862

(22) Filed: Nov. 15, 2013

(65) Prior Publication Data

US 2014/0142837 A1 May 22, 2014

(30) Foreign Application Priority Data

Nov. 20, 2012 (JP) ..... 2012-254590

(51) Int. Cl.
*G08G 1/16* (2006.01)

(52) U.S. Cl.
CPC ..... *G08G 1/166* (2013.01); *G08G 1/165* (2013.01)

(58) Field of Classification Search
CPC ..... G08G 1/166; G01S 7/4004; G01S 13/931; G01S 13/345; G01S 7/411; G01S 7/4802; G05D 1/0214; G05D 1/0238; G01C 7/4802
USPC ..... 701/25, 301; 342/70, 54; 340/970
See application file for complete search history.

(56) References Cited

U.S. PATENT DOCUMENTS 6,480,120 B1 * 11/2002 Meunier ..... 340/970
2003/0105578 A1 6/2003 Takenaga et al.
2005/0270225 A1 * 12/2005 Tokoro ..... 342/70
2009/0043440 A1 * 2/2009 Matsukawa et al. ..... 701/25
2010/0265101 A1 10/2010 Takenaga et al.
2011/0006941 A1 * 1/2011 Samukawa et al. ..... 342/70
2011/0248880 A1 * 10/2011 Miyahara et al. ..... 342/54

(Continued)

FOREIGN PATENT DOCUMENTS

JP 06-230115 8/1994
JP 06-231398 8/1994
JP 06-2230115 8/1994

(Continued)

OTHER PUBLICATIONS

Office Action dated Sep. 9, 2014 in corresponding Japanese Application No. 2012-254590.

(Continued)

*Primary Examiner* — Tuan C. To
*Assistant Examiner* — Yuri Kan
(74) *Attorney, Agent, or Firm* — Harness, Dickey & Pierce, PLC

(57) ABSTRACT

An object type determination apparatus mounted in a vehicle. In the apparatus, a detection unit detects an object present forward of the vehicle. A height estimation unit estimates a height of the object detected by the detection unit from a road surface. A determination unit uses the estimation result of the height estimation unit to determine, according to one of a plurality of predefined criteria, whether or not the object is an object for which a collision avoidance process is performed. A complex environment estimation unit estimates a likelihood that a complex environment is present forward of the vehicle. A criterion selection unit selects the one of the plurality of predefined criteria used by the determination unit on the basis of the estimation result of the complex environment estimation unit.

9 Claims, 8 Drawing Sheets

(56) References Cited

U.S. PATENT DOCUMENTS

| | | | | |
|---|---|---|---|---|
| 2012/0056773 | A1 | 3/2012 | Sato | |
| 2013/0082868 | A1* | 4/2013 | Ohkado et al. | 342/70 |

FOREIGN PATENT DOCUMENTS

| | | | |
|---|---|---|---|
| JP | 07-182484 | | 7/1995 |
| JP | 2003-168197 | | 6/2003 |
| JP | 2004-198438 | | 7/2004 |
| JP | 2005-332120 | | 12/2005 |
| JP | 2005-345251 | | 12/2005 |
| JP | 2008-037361 | | 2/2008 |
| JP | 2010-132056 | | 6/2010 |
| JP | 2011-017634 | | 1/2011 |
| JP | 2011064482 | A * | 3/2011 |
| JP | 2012-002637 | | 1/2012 |
| JP | 2012-058018 | | 3/2012 |

OTHER PUBLICATIONS

Office Action dated Apr. 21, 2015 in corresponding Japanese Application No. 2012-254590.

* cited by examiner

OBJECT TYPE DETERMINATION APPARATUS

CROSS-REFERENCE TO RELATED APPLICATION

This application is based on and claims the benefit of priority from earlier Japanese Patent Application No. 2012-254590 filed Nov. 20, 2012, the description of which is incorporated herein by reference.

BACKGROUND

1. Technical Field

The present invention relates to an apparatus for determining a type of object present around a vehicle.

2. Related Art

A known apparatus, as disclosed in Japanese Patent Application Laid-Open Publication No. 2008-37361, detects an object, such as a pedestrian or the like, present outside of a controlled vehicle (i.e., a vehicle mounting therein the apparatus) with a radar, and determines the detected object as an obstacle when a reflectance of the object is equal to or greater than a threshold. The disclosed apparatus determines a road class that the controlled vehicle is traveling by using a navigation device, and raises the threshold to a value greater than normal when the road that the controlled vehicle is traveling is a highway, on which an obstacle, such as a pedestrian or the like, is less likely to lie, thereby preventing an object, such as a manhole cover or the like, from being determined as an obstacle.

The apparatus as disclosed in Japanese Patent Application Laid-Open Publication No. 2008-37361, however, is likely to determine an object, such as a manhole cover or the like, on a road other than the highway, as an obstacle. In addition, in a vehicle having no navigation device, the above determination technique cannot be implemented.

In consideration of the foregoing, it would therefore be desirable to have an apparatus mounted in a vehicle, capable of properly determining an object present around the vehicle as an obstacle.

SUMMARY

In accordance with an exemplary embodiment of the present invention, there is provided an object type determination apparatus mounted in a vehicle, including: a detection unit configured to detect an object present forward of the vehicle; a height estimation unit configured to estimate a height of the object detected by the detection unit from a road surface; a determination unit configured to use the estimation result of the height estimation unit to determine, according to one of a plurality of predefined criteria, whether or not the object is an object for which a collision avoidance process is performed; a complex environment estimation unit configured to estimate a likelihood that a complex environment is present forward of the vehicle; and a criterion selection unit configured to select the one of the plurality of predefined criteria used by the determination unit on the basis of the estimation result of the complex environment estimation unit.

With this configuration, the object type determination apparatus is allowed to detect an object, estimate a height of the object from a road surface, and on the basis of the estimation result, determine whether or not the object is a collision avoidance system activation object according to a predetermined criterion.

The object type determination apparatus further includes: a complex environment estimation unit configured to estimate a likelihood that a complex environment is present forward of the vehicle; and a criterion selection unit configured to select one of the plurality of predefined criteria used by the determination unit on the basis of the estimation result of the complex environment estimation unit.

With this configuration, for higher confidence in estimation of the height of the object when it less likely that a complex environment is present forward of the controlled vehicle, the criterion may be set such that it is more determinable that the object is a collision avoidance system activation object, that is, an object for which the collision avoidance process is performed. This leads to enhancement of vehicle safety. For lower confidence in estimation of the height of the object when it more likely that a complex environment is present forward of the controlled vehicle, the criterion may be set such that it is less determinable that the object is a collision avoidance system activation object. This can prevent the collision avoidance process from being unnecessarily performed.

DESCRIPTION OF SPECIFIC EMBODIMENTS

The present invention will be described more fully hereinafter with reference to the accompanying drawings in which specific embodiments of the invention are shown. Like numbers refer to like elements throughout.

First Embodiment

1. Configuration of Object Type determination Apparatus

Figure 1A:
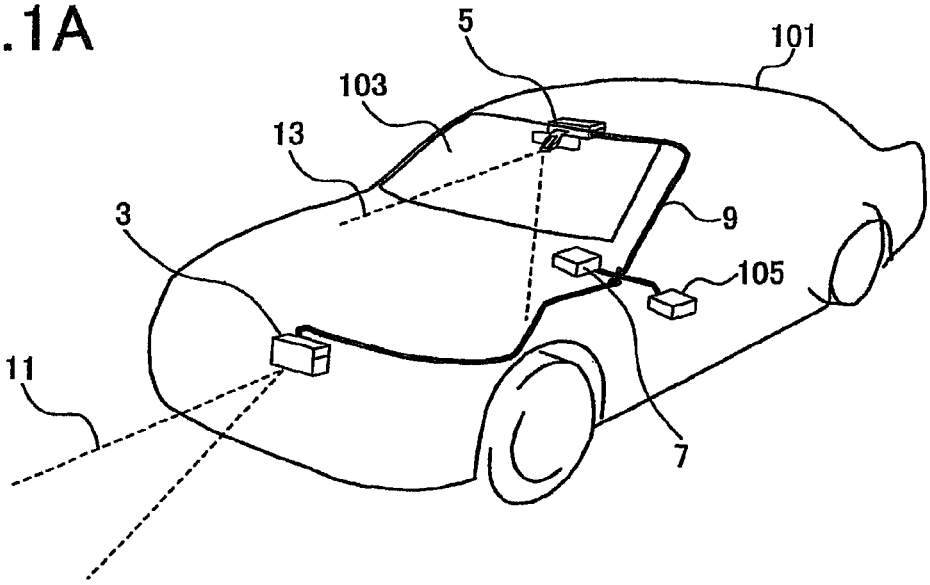
FIG. 1A shows a schematic block diagram of an object type determination apparatus in accordance with a first embodiment of the present invention.

A configuration of an object type determination apparatus 1 in accordance with a first embodiment of the present invention will now be explained with reference to FIG. 1. The object type determination apparatus 1 is mounted in a vehicle (hereinafter also referred to as a controlled vehicle) 101, and includes a millimeter wave sensor 3, an image sensor 5, and a computer 7, each connected to an in-vehicle network 9.

The millimeter wave sensor 3, which serves as a detection unit and may be an FM-CW millimeter-wave radar, is mounted in a forward section of the vehicle 101. The millimeter wave sensor 3 transmits and receives frequency-modulated radar waves of the millimeter wave band to detect the presence of a reflective object and determine a direction and a distance from the controlled vehicle to the object. A coverage 11 of the millimeter wave sensor 3 may include a vehicle other than the controlled vehicle, a pedestrian, a road iron plate (a manhole cover etc.), a tunnel and others present forward of the controlled vehicle.

The image sensor 5, which may be a camera configured in a well-known manner, is disposed close to an upper end of a front shield 103 to capture images of the scene in front of the controlled vehicle. A coverage 13 of the image sensor 5 may include a vehicle other than the controlled vehicle, a pedestrian, a road iron plate (a manhole cover etc.), a tunnel and others present forward of the controlled vehicle 101.

The computer 7, which may include CPU (not shown), ROM (not shown), RAM (not shown), and others configured in a well-known manner, performs processes (which will be described later) according to programs stored in the ROM or the like.

The vehicle 101 further includes a collision avoidance apparatus 105 configured to perform a collision avoidance process when it is determined by the object type determination apparatus 1 that there exists a collision avoidance system activation object described later and a few additional conditions are met. The collision avoidance process may include braking the traveling vehicle 101. Alternatively, the collision avoidance process may include changing the course of the controlled vehicle 101 by steering or alerting a driver of the controlled vehicle 101.

In the collision avoidance apparatus 105, a time difference from when it is determined that there exists a collision avoidance system activation object and the additional conditions are met until the collision avoidance process is initiated. A collision avoidance system activation timing at which the collision avoidance process is initiated after it is determined that there exists a collision avoidance system activation object and the additional conditions are met is variably set in a process performed by the object type determination apparatus 1, which will be described later.

Figure 1B:
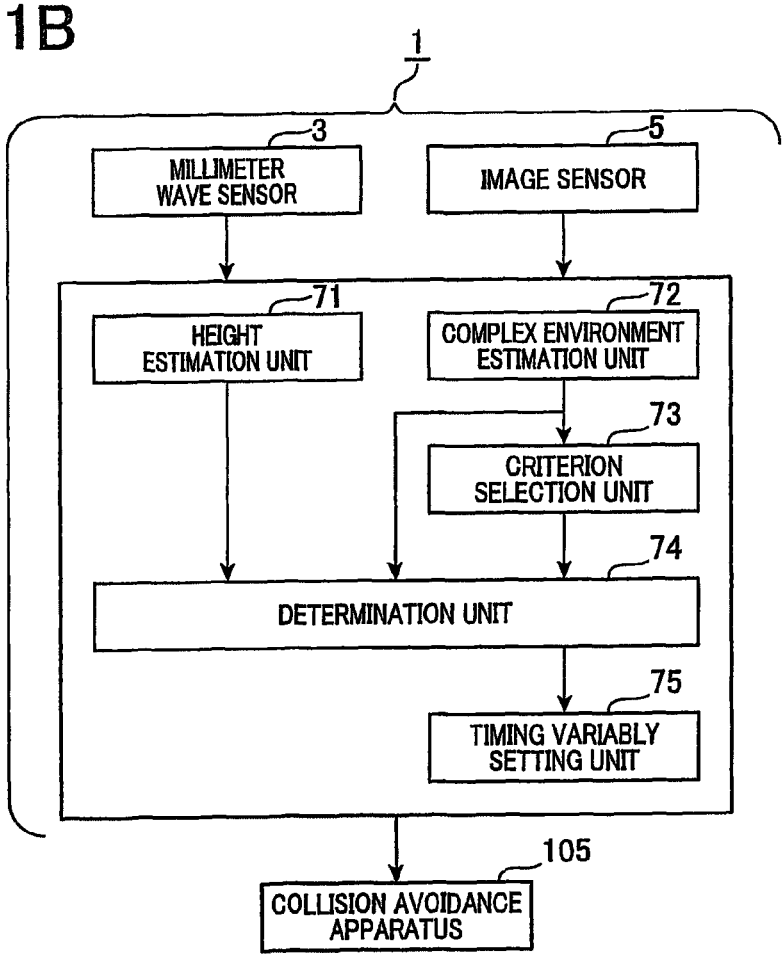
FIG. 1B shows a schematic functional block diagram of a computer in the object type determination apparatus of FIG. 1A.

As shown in FIG. 1B, the computer 7 includes a height estimation unit 71, a complex environment estimation unit 72, criterion selection unit 73, a determination unit 74, and a timing variably setting unit 75.

The height estimation unit 71 is configured to estimate a height of the object detected by the millimeter wave sensor 3 from a road surface on the basis of a correlation between the intensity of the reflected radar wave signal from the object and a distance from the vehicle 101 to the object.

The determination unit 74 is configured to use the estimation result of the height estimation unit 71 to determine, according to one of a plurality of predefined criteria, whether or not the object is an object for which a collision avoidance process is performed.

The complex environment estimation unit 72 is configured to estimate a likelihood that a complex environment is present forward of the vehicle 101.

The criterion selection unit 73 is configured to select one of the plurality of predefined criteria used by the determination unit 74 on the basis of the estimation result of the complex environment estimation unit 72.

The timing variably setting unit 75 is configured to variably set a timing at which the collision avoidance process is initiated after it is determined by the determination unit 74 that the detected object is an object for which the collision avoidance process is performed.

2. Process Performed in the Object Type Determination Apparatus

A process performed in the object type determination apparatus 1 will now be explained with reference to FIGS. 2-8.

Figure 2:
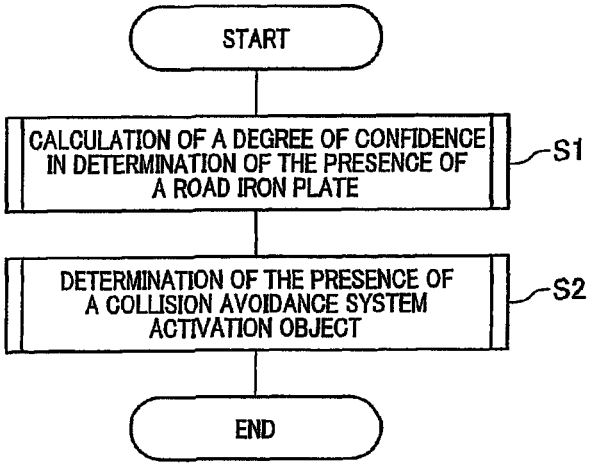
FIG. 2 shows a flowchart of an overall process performed in the object type determination apparatus of FIG. 1A.

FIG. 2 shows a flowchart of an overall process performed in the object type determination apparatus 1, particularly, in the computer 7. This process is performed when an object is detected forward of the controlled vehicle 101 by the millimeter wave sensor 3. In step S1, a process of calculating a degree of confidence in determination of the presence of a road iron plate is performed. In step S2, a process of determining the presence of a collision avoidance system activation object is performed. The processes of steps S1, S2 will be described later in more detail.

The process of calculating a degree of confidence in determination of the presence of a road iron plate will now be explained with reference to FIG. 3.

In step S11, it is determined by using the millimeter wave sensor 3 whether or not a complex environment is present forward of the controlled vehicle 101. The complex environment may include an environment where a steel-walled or concrete-walled hollow region is present forward of the controlled vehicle 101 and above the road that the controlled vehicle 101 is traveling, for example, the inside of a tunnel, or an environment where a plurality of reflective objects, such as people crowds, roadside poles, or guardrails, are present forward of the controlled vehicle 101. Since, in such a complex environment, radar waves transmitted from the millimeter wave sensor 3 may be reflected from objects other than obstacles to traveling of the vehicle, a degree of confidence in estimation described later of a height of object from a road surface diminishes as compared with in a non-complex environment.

Figure 7:
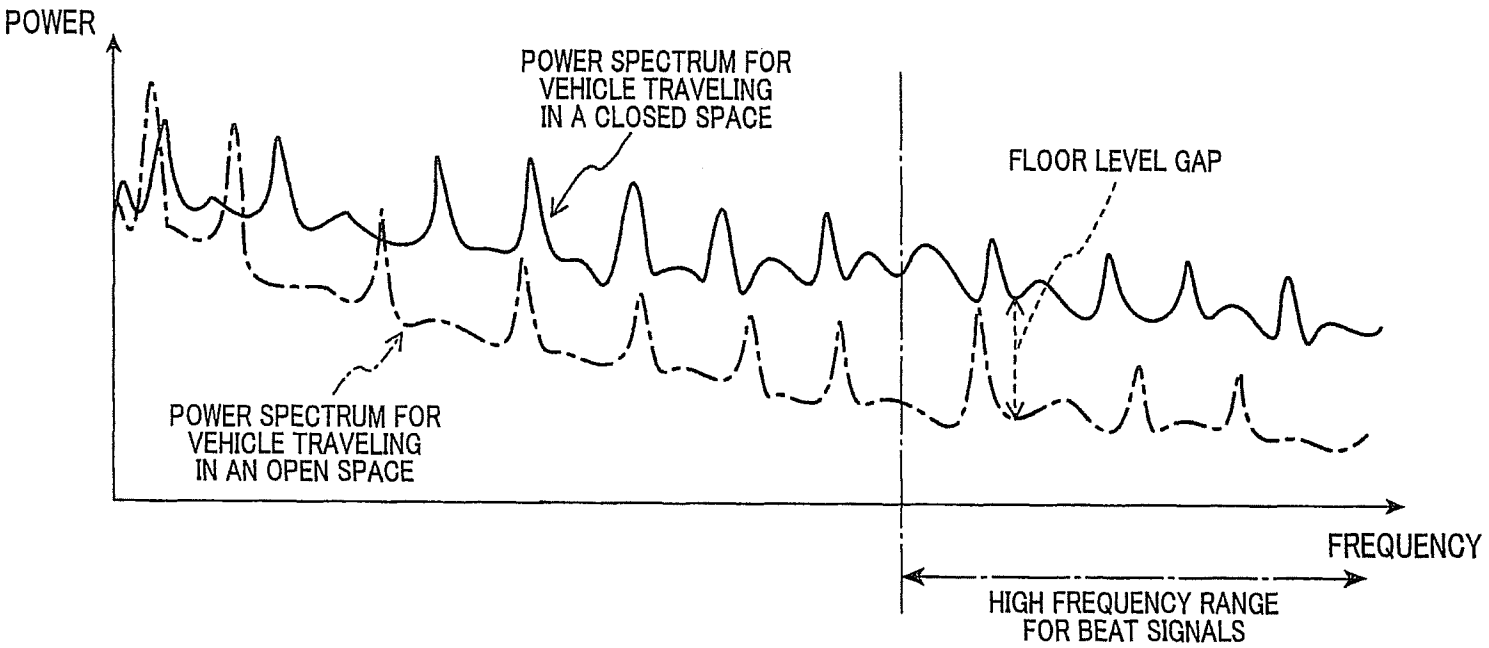
FIG. 7 shows an example of determining the presence of a complex environment forward of a controlled vehicle.

Determining the presence of such a complex environment forward of the vehicle is performed by means of a well-known technique as disclosed in Japanese Patent Application Laid-Open Publication No. 2012-58018, which is based on the fact that, as shown in FIG. 7, in complex environments, a floor level of a power spectrum obtained by applying frequency analysis to a beat signal that is a mixture of a transmitted millimeter wave signal and a received reflected wave signal is raised as compared with in non-complex environments. It may therefore be determined that a complex environment is present forward of the controlled vehicle 101 when the floor level is higher than a predetermined threshold, whereas it may be determined that a complex environment is not present forward of the controlled vehicle 101 when the floor level is equal to or lower than the predetermined threshold.

Figure 3:
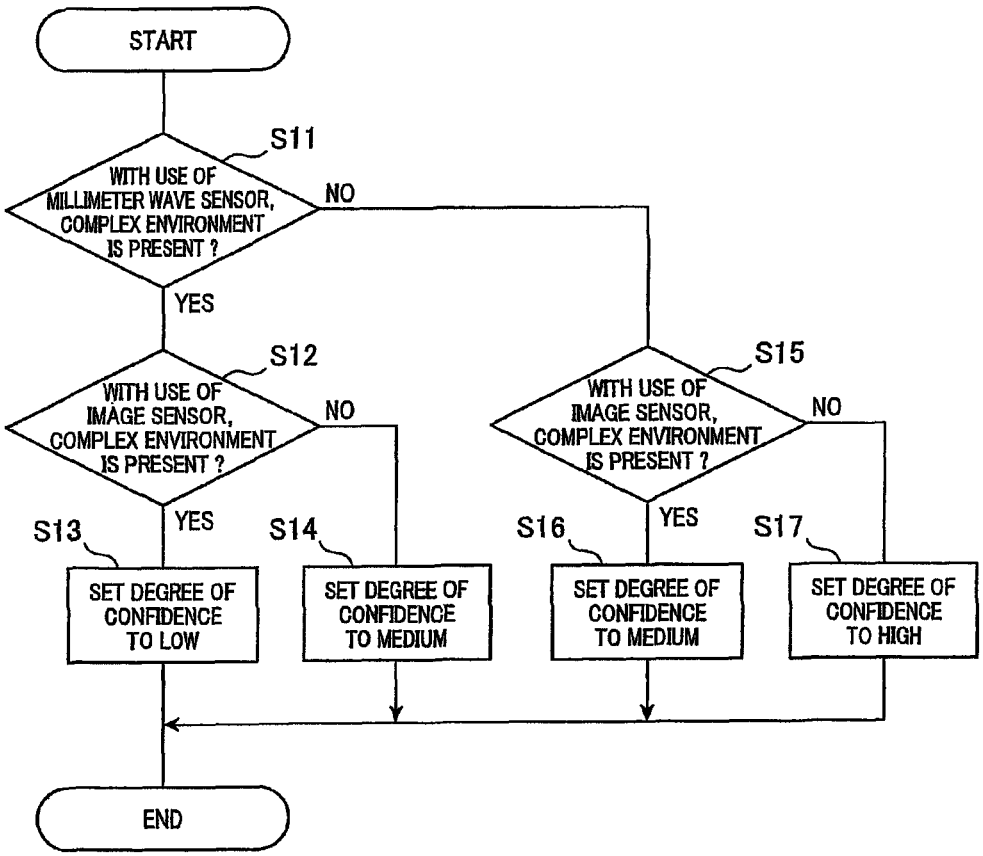
FIG. 3 shows a flowchart of a process of calculating a degree of confidence in determination of the presence of a road iron plate performed in the object type determination apparatus of FIG. 1A.

As shown in the flowchart of FIG. 3, if it is determined in step S11 that such a complex environment is present forward of the controlled vehicle 101, then the flow proceeds to step S12. If it is determined in step S11 that such a complex environment is not present forward of the controlled vehicle, then the flow proceeds to step S15.

In step S12, it is determined by using the image sensor 5 whether or not a complex environment is present forward of the controlled vehicle. More specifically, it is determined by applying image recognition to the images forward and upward of the controlled vehicle 101 acquired from the image sensor 5 whether or not an environment such that a steel-walled or concrete-walled hollow region is present forward of the controlled vehicle 101 and above the road that the controlled vehicle 101 is traveling, for example, the inside of a tunnel, or an environment such that a plurality of reflective objects, such as people crowds, roadside poles, or guardrails, are present forward of the controlled vehicle is present forward of the controlled vehicle. If it is determined in step S12 that such a complex environment is present forward of the controlled vehicle 101, then the flow proceeds to step S13. If it is determined in step S12 that such a complex environment is not present forward of the controlled vehicle 101, then the flow proceeds to step S14.

In step S13, the degree of confidence in determination of the presence of a road iron plate is set low. In step S14, the degree of confidence in determination of the presence of a road iron plate is set medium.

If it is determined in step S11 that a complex environment is not present forward of the controlled vehicle 101, then the flow proceeds to step S15, where it is determined in a similar manner as in step S12 by using the image sensor 5 whether or not a complex environment is present forward of the controlled vehicle 101. If it is determined in step S15 that a complex environment is present forward of the controlled vehicle 101, then the flow proceeds to step S16. If it is determined in step S15 that a complex environment is not present forward of the controlled vehicle 101, then the flow proceeds to step S17.

In step S16, the degree of confidence in determination of the presence of a road iron plate is set medium. In step S17, the degree of confidence in determination of the presence of a road iron plate is set high.

Figure 4:
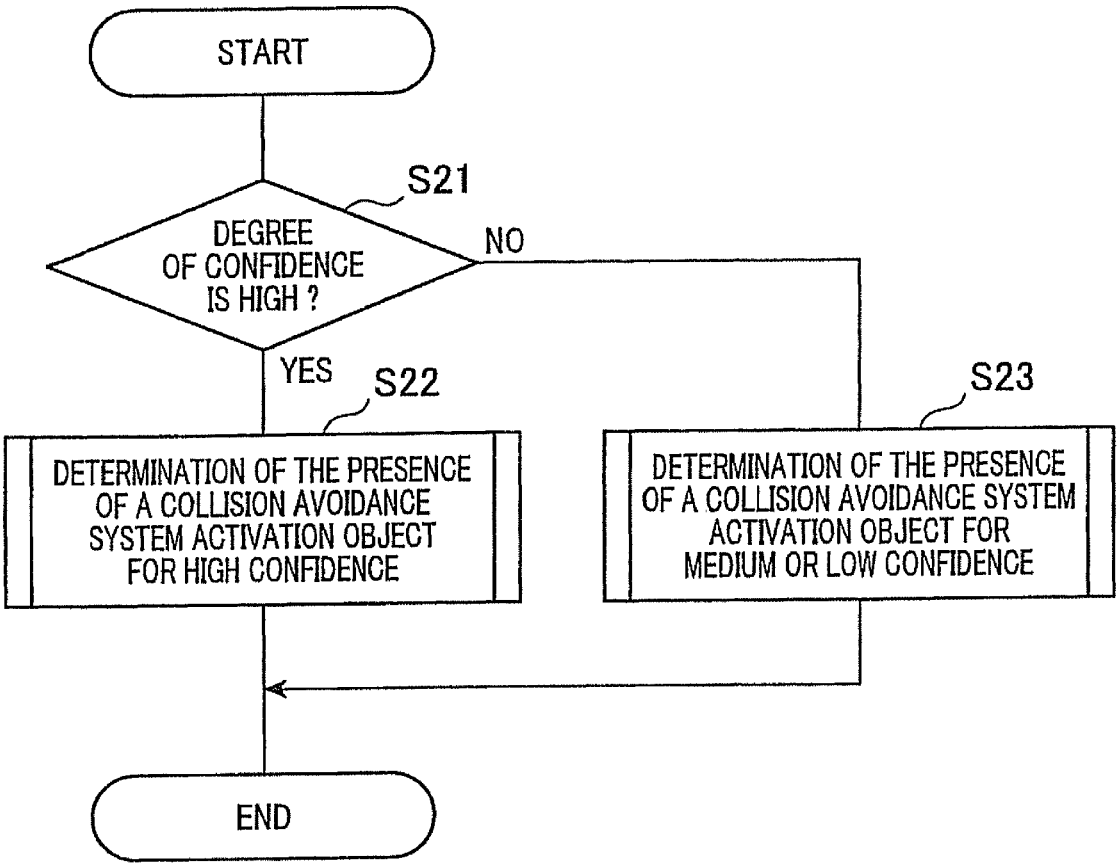
FIG. 4 shows a flowchart of a process of determining the presence of a collision avoidance system activation object performed in the object type determination apparatus of FIG. 1A.

FIG. 4 shows a flowchart of a process of determining the presence of a collision avoidance system activation object performed in the object type determination apparatus 1. In step S21, it is determined whether or not the degree of confidence in determination of the presence of a road iron plate is high. If it is determined in step S21 that the degree of confidence in determination of the presence of a road iron plate is high, then the flow proceeds to step S22. If it is determined in step S21 that the degree of confidence in determination of the presence of a road iron plate is medium or low, then the flow proceeds to step S23. In step S22, a process of determining the presence of a collision avoidance system activation object for high confidence is performed. In step S23, a process of determining the presence of a collision avoidance system activation object for medium or low confidence is performed.

Figure 5:
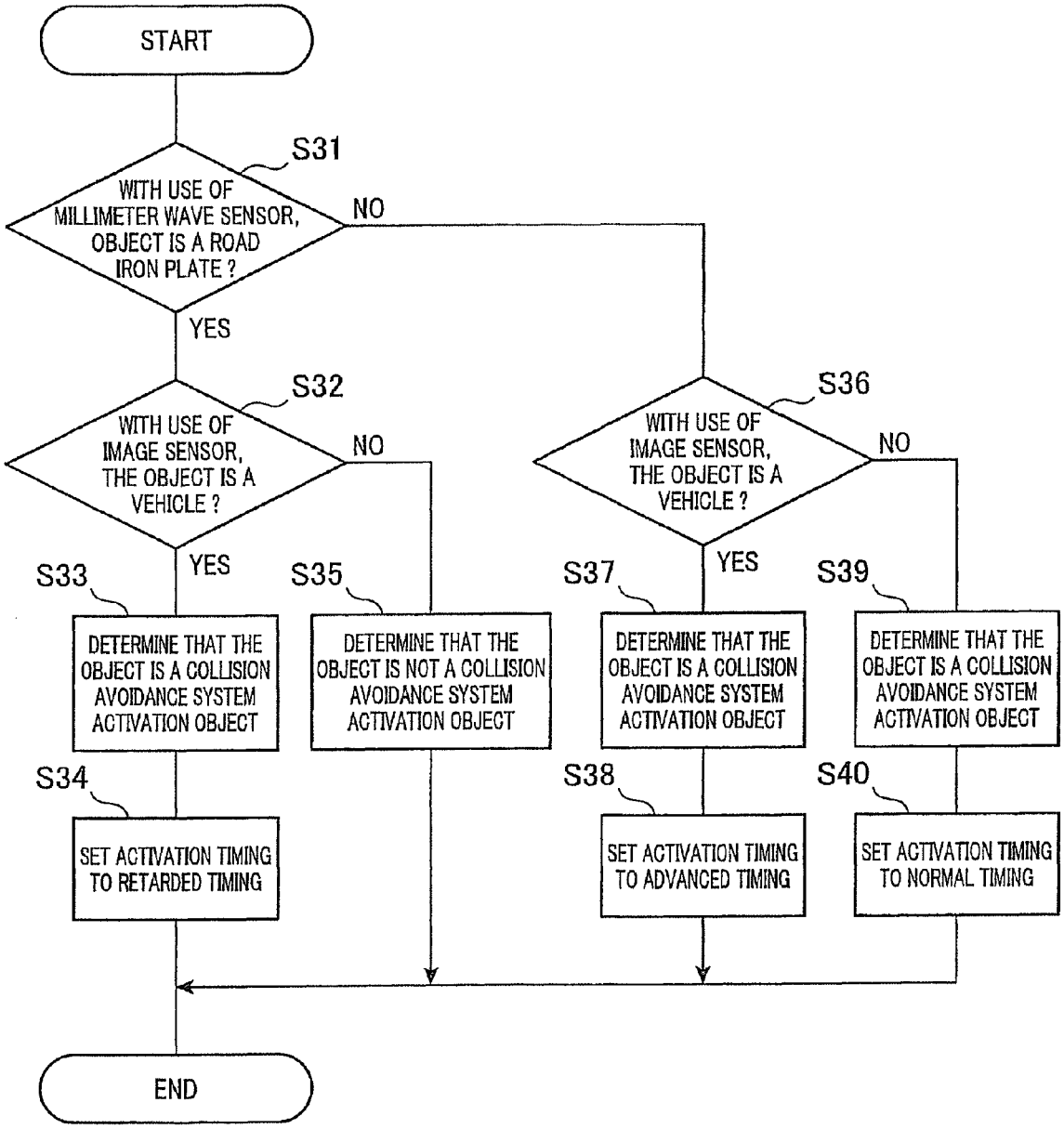
FIG. 5 shows a flowchart of a process of determining the presence of a collision avoidance system activation object for high confidence performed in the object type determination apparatus of FIG. 1A.

The process of determining the presence of a collision avoidance system activation object for high confidence will now be explained with reference to FIG. 5. In step S31, a height of an object detected by the millimeter wave sensor 3 from a road surface is estimated, and it is then determined, on the basis of the estimation, whether or not the object is a road iron plate (e.g., a manhole cover or the like). The road iron plate is an example of object, whose height from the road surface is low enough to be passed over by the controlled vehicle 101. The height of the object from the road surface may be estimated by using a well-known technique as disclosed in Japanese Patent Application Laid-Open Publication No. 2011-17634, on the basis of a correlation between the intensity of a reflected wave signal from the object and a distance from the controlled vehicle 101 to the object.

Figure 8A:
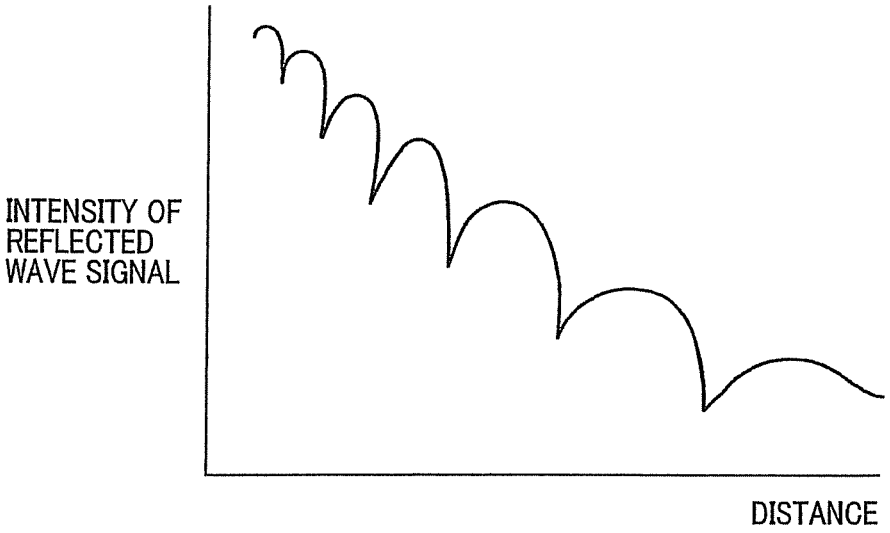
FIG. 8A shows an example of multipath-specific variation pattern in which the intensity of a reflected wave signal varies as a function of a distance.

In the presence of an object whose height from a road surface is high, a received reflected wave signal may include a first reflected wave signal component that is received directly (corresponding to a first reflection path) and a second reflected wave signal component that is received after one reflection from a road surface (corresponding to a second reflection path). When a phase difference between the first and second reflected wave signal components are such that the first and second reflected wave signal components cancel out each other, the intensity of the reflected wave signal diminishes, which causes the intensity of the reflected wave signal varies in a multipath-specific variation pattern as a function of a distance from the controlled vehicle 101 to the object, as shown in FIG. 8A.

Figure 8B:
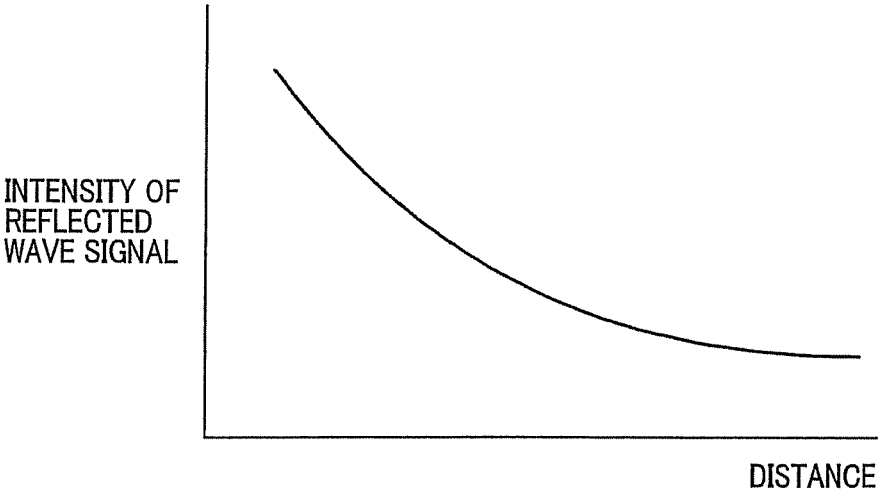
FIG. 8B shows an example of single-path-specific variation pattern in which the intensity of a reflected wave signal varies as a function of a distance.

In the presence of an object whose height from a road surface is low, a reflected wave signal may be received directly without being reflected from a road surface. As shown in FIG. 8B, the intensity of the reflected wave signal monotonically increases with decreasing distance from the controlled vehicle 101 to the object.

Therefore, if the intensity of the reflected wave signal varies in a multipath-specific variation pattern as a function of a distance from the controlled vehicle 101 to the object, it may be determined that the object is not a road iron plate, but an object whose height from a road surface is high, such as a vehicle or the like. If the intensity of the reflected wave signal doesn't vary in such a multipath-specific variation pattern, then it may be determined that the object is a road iron plate.

If it is determined in step S31 that the object is a road iron plate, then the flow proceeds to step S32. If it is determined in step S31 that the object is not a road iron plate, then the flow proceeds to step S36.

In step S32, it is determined whether or not the object is a vehicle. More specifically, it is determined by applying image recognition to the images from the image sensor 5 to determine a distance and a direction from the controlled vehicle 101 to the object and determining whether or not there exists a vehicle whose distance and direction coincide with the distance and the direction determined by the millimeter wave sensor 3. The vehicle is generally an object whose height from a road surface is too high to be passed over by the controlled vehicle 101. If it is determined that there exists a vehicle whose distance and direction coincide with the distance and the direction determined by the millimeter wave sensor 3, then it is determined that the object is a vehicle. The flow then proceeds to step S33. If there doesn't exist any vehicle whose distance and direction coincide with the distance and the direction determined by the millimeter wave sensor 3, then it is determined that the object is not a vehicle. The flow then proceeds to step S35.

In step S33, it is determined that the object detected by the millimeter wave sensor 3 is a collision avoidance system activation object, i.e., an object for which the collision avoidance process is performed. In step S35, it is determined that the object detected by the millimeter wave sensor 3 is not a collision avoidance system activation object. In step S34, a collision avoidance system activation timing, that is, a timing at which the collision avoidance process is initiated, is retarded relative to a normal timing.

If it is determined in step S31 that the object detected by the millimeter wave sensor 3 is not a road iron plate, then the flow proceeds to step S36, where it is determined by using the image sensor 5 in a similar manner as in step S32, whether or not the object is a vehicle. If it is determined in step S36 that the object is a vehicle, then the flow proceeds to step S37. If it is determined in step S36 that the object is not a vehicle, then the flow proceeds to step 39.

In steps S37, S39, it is determined that the object is a collision avoidance system activation object. In step S38, the system activation timing is advanced relative to the normal timing. In step S40, the collision avoidance system activation timing is retarded relative to the normal timing.

Figure 6:
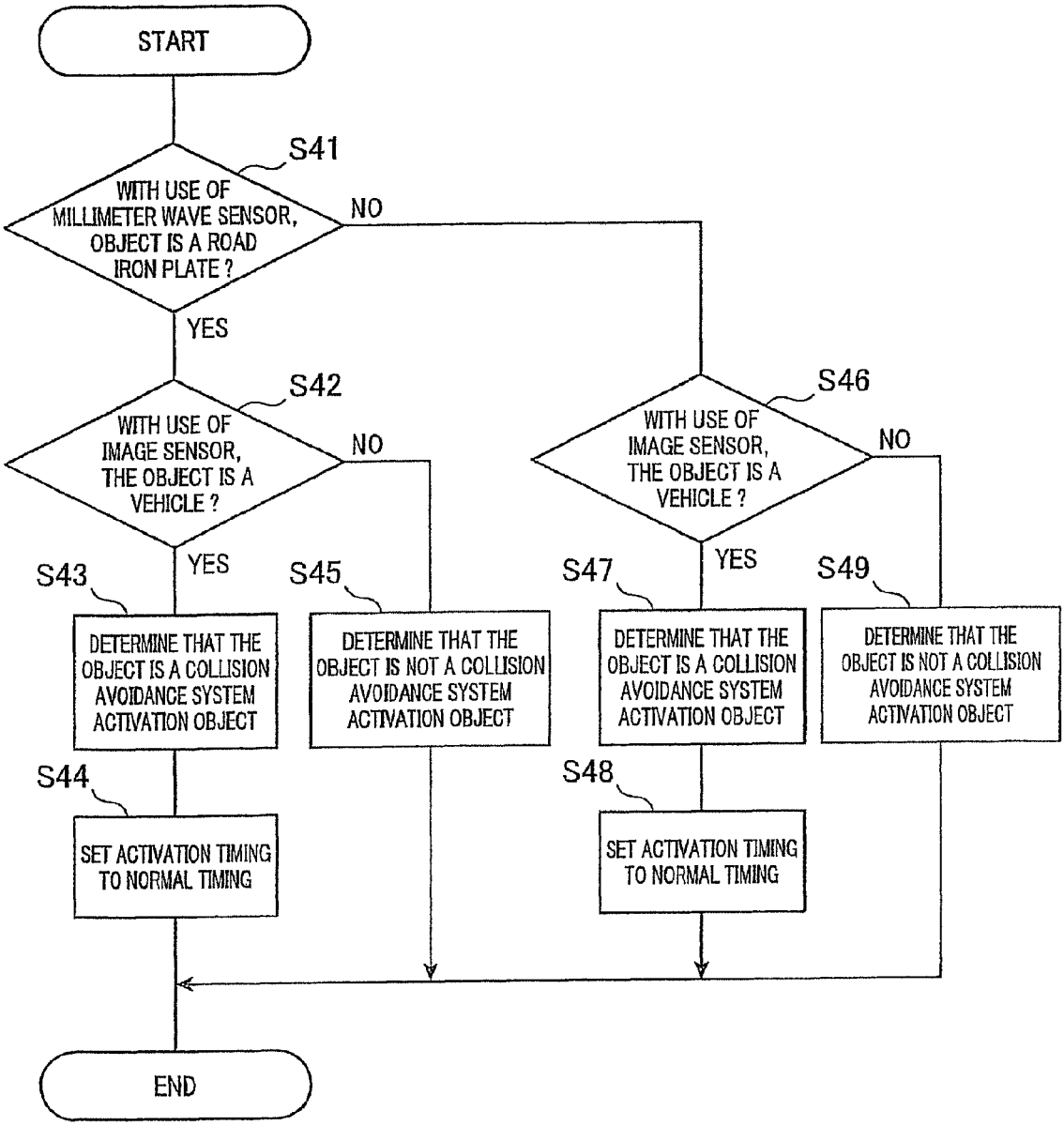
FIG. 6 shows a flowchart of a process of determining the presence of a collision avoidance system activation object for medium or low confidence performed in the object type determination apparatus of FIG. 1A.

The process of determining the presence of a collision avoidance system activation object for medium or low confidence will now be explained with reference to FIG. 6. In step S41, a height of an object detected by the millimeter wave sensor 3 from a road surface is estimated, and it is then determined on the basis of the estimation in a similar manner as in step S31 whether or not the object is a road iron plate (e.g., a manhole cover or the like). If it is determined in step S41 that the object is a road iron plate, then the flow proceeds to step S42. If it is determined in step S41 that the object is not a road iron plate, then the flow proceeds to step S46.

In step S42, it is determined by using the image sensor 5 in a similar manner as in step S32 whether or not the object detected by the millimeter wave sensor 3 is a vehicle. If it is determined in step S42 that the object is a vehicle, then the flow proceeds to step S43. If it is determined in step S42 that the object is not a vehicle, then the flow proceeds to step S45.

In step S43, it is determined that the object detected by the millimeter wave sensor 3 is a collision avoidance system activation object, i.e., an object for which the collision avoidance process is performed. In step S45, it is determined that the object detect by the millimeter wave sensor 3 is not a collision avoidance system activation object. In step S44, the collision avoidance system activation timing is set to a normal timing.

If it is determined in step S41 that the object detected by the millimeter wave sensor 3 is not a road iron plate, then the flow proceeds to step S46, where it is determined by using the image sensor 5 in a similar manner as in step S32, whether or not the object is a vehicle. If it is determined in step S46 that the object is a vehicle, then the flow proceeds to step S47. If it is determined in step S46 that the object is not a vehicle, then the flow proceeds to step 49.

In step S47, it is determined that the object detected by the millimeter wave sensor 3 is a collision avoidance system activation object, i.e., an object for which the collision avoidance process is performed. In step S49, it is determined that the object detect by the millimeter wave sensor 3 is not a collision avoidance system activation object. In step S48, the collision, avoidance system activation timing is set to a normal timing.

When it is determined that the object detected by the millimeter wave sensor 3 is a collision avoidance system activation object, the collision avoidance apparatus 105 performs the collision avoidance process, provided that a few additional conditions are met. Meanwhile, when it is determined that the object detected by the millimeter wave sensor 3 is not a collision avoidance system activation object, the collision avoidance apparatus 105 will not perform the collision avoidance process. The collision avoidance apparatus 105 utilizes the above set forth system activation timings.

The height estimation unit 71 is responsible for execution of the operations in steps S31, S41. The complex environment estimation unit 72 is responsible for execution of the operations in steps S11-S17. The criterion selection unit 73 is responsible for execution of the operations in steps S21-S23. The determination unit 74 is responsible for execution of the operations in steps S31-33, S35, S36, S37, S39, S41-43, S45, S46, S47, and S49. The timing variably setting unit 75 is responsible for execution of the operations in steps S34, S38, S40, S44, and S48.

3. Some Advantages of the Object Type Determination Apparatus (1) The object type determination apparatus 1 detects an object by using the millimeter wave sensor 3, and determines whether or not the detected object is a road iron plate, that is, whether a height of the object from a road surface is high or low (see steps S31, S41). Based on the determination of whether or not the detected object is a road iron plate, the object type determination apparatus 1 determines whether or not the object is a collision avoidance system activation object according to a predefined criterion (see steps S31-33, S35, S36, S37, S39, S41-43, S45, S46, S47, S49).

In the present embodiment, the object type determination apparatus 1 uses the determination of the presence of a complex environment by means of the millimeter wave sensor 3 and the determination of the presence of a complex environment by means of the image sensor 5 to determine whether a degree of confidence in determination of the presence of a road iron plate is high, medium, or low (see steps S 11-17). The degree of confidence in determination of the presence of a road iron plate is a parameter which decreases with increasing likelihood that a complex environment (an environment such that a steel-walled or concrete-walled hollow region is present forward of the controlled vehicle 101 and above the road, for example, the inside of a tunnel) is present forward of the controlled vehicle 101. The object type determination apparatus 1 estimates a likelihood that such a complex environment is present forward of the controlled vehicle 101 by using the millimeter wave sensor 3 and the image sensor 5.

Based on a likelihood that such a complex environment is present forward of the controlled vehicle 101 (the degree of confidence in determination of the presence of a road iron plate), the object type determination apparatus 1 changes a criterion for determining whether or not the object is a collision avoidance system activation target object. More specifically, for a low likelihood that a complex environment is present forward of the controlled vehicle 101 (i.e., for a high degree of confidence in determination of the presence of a road iron plate), when it is determined by using the millimeter wave sensor 3 that the object is not a road iron plate and it is determined by using the image sensor 5 that the object is not a vehicle, it is determined that the object is a collision avoidance system activation object (see steps S31, S36, S39). Meanwhile, for a high likelihood that a complex environment is present forward of the controlled vehicle 101 (i.e., for a medium or low degree of confidence in determination of the presence of a road iron plate), when it is determined by using the millimeter wave sensor 3 that the object is not a road iron plate and it is determined by using the image sensor 5 that the object is not a vehicle, it is determined that the object is not a collision avoidance system activation object (see steps S41, S46, S49).

With this configuration, when it is less likely that a complex environment is present forward of the controlled vehicle 101 and it is therefore determined with high confidence that the object detected by the millimeter wave sensor 3 is not a road iron plate (i.e., it is more likely that the object is a vehicle), the object type determination apparatus 1 is allowed to determine that the object is a collision avoidance system activation object, which leads to enhanced vehicle safety.

In addition, when it is more likely that a complex environment is present forward of the controlled vehicle 101 and it is therefore determined with low confidence that the object detected by the millimeter wave sensor 3 is not a road iron plate (i.e., it is less likely that the object is a vehicle), the object type determination apparatus 1 is not allowed to determine that the object is a collision avoidance system activation object, which prevents the collision avoidance process from being unnecessarily performed.

(2) The object type determination apparatus 1 is configured to advance the collision avoidance system activation timing further as it is more likely that the object is a vehicle. Since, when it is determined by using the millimeter wave sensor 3 that the object is not a road iron plate and it is then determined by using the image sensor 5 that the object is a vehicle (as in steps S37, S38), it is most likely that the object is a vehicle, the collision avoidance system activation timing is more advanced than in steps S33, S34 or in steps S39, S40. This can more efficiently prevent the controlled vehicle from colliding with another vehicle.

4. Some Modifications

In each of steps S31, S41, a threshold used to determine whether or not the object detected by the millimeter wave sensor 3 is a road iron plate may be changed as a function of a degree of confidence in determination of the presence of a road iron plate. For example, the threshold used to determine whether or not the object detected by the millimeter wave sensor 3 is a road iron plate may be increased with decreasing degree of confidence in in determination of the presence of a road iron plate, which can prevent an object that is not actually a road iron plate from being mis-determined as a road iron plate.

Second Embodiment

There will now be explained a second embodiment of the present invention. Only differences of the second embodiment from the first embodiment will be explained.

Figure 9:
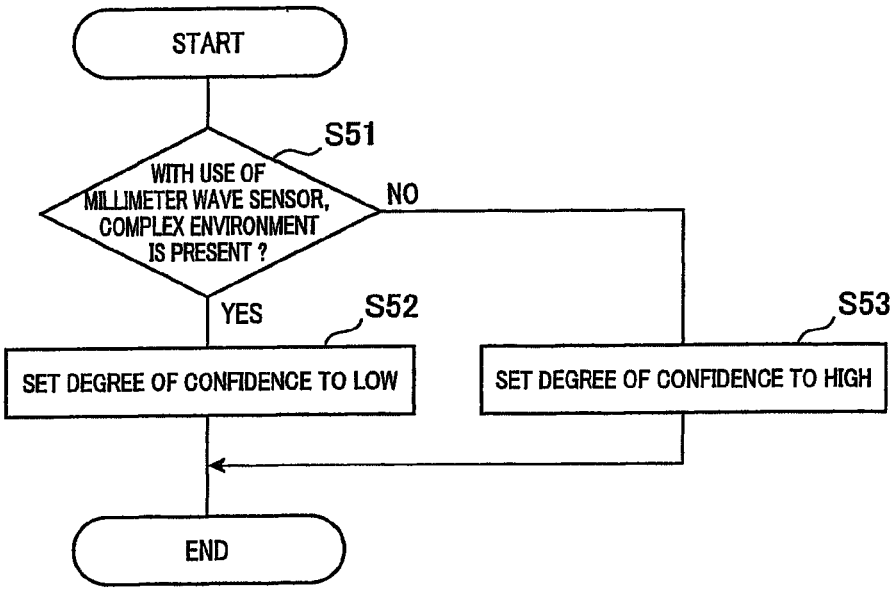
FIG. 9 shows a flowchart of a process of calculating a degree of confidence in determination of the presence of a road iron plate performed in an object type determination apparatus in accordance with a second embodiment of the present invention.

FIG. 9 shows a process of calculating a degree of confidence in determination of the presence of a road iron plate performed in the object type determination apparatus 1.

In step S51, it is determined by using the millimeter wave sensor 3 whether or not a complex environment (as described above in the first embodiment) is present forward of the controlled vehicle 101 in a similar manner as in step 11 of the first embodiment. If it is determined in step S51 that a complex environment is present forward of the controlled vehicle 101, then the flow proceeds to step S52. If it is determined in step S51 that a complex environment is not present forward of the controlled vehicle 101, then the flow proceeds to step S53.

In step S52, the degree of confidence in determination of the presence of a road iron plate is set low. In step S53, the degree of confidence in determination of the presence of a road iron plate is set high.

Figure 10:
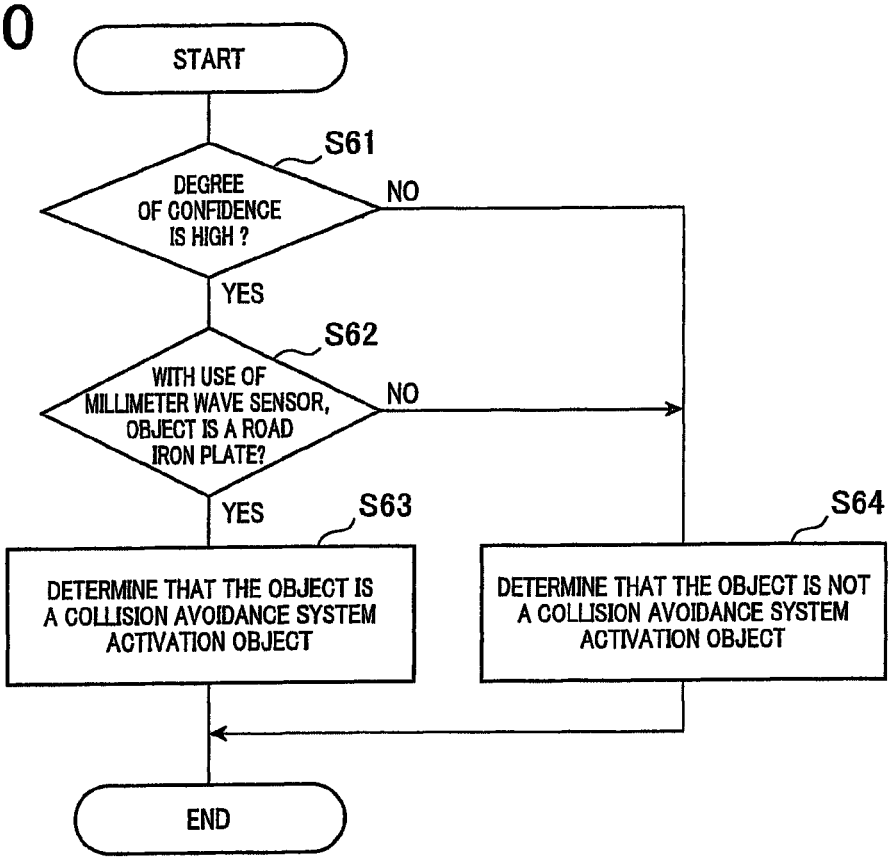
FIG. 10 shows a flowchart of a process of determining the presence of a collision avoidance system activation object performed in the object type determination apparatus of FIG. 9.

The object type determination apparatus 1 performs a process of determining the presence of a collision avoidance system activation object, as shown in FIG. 10. In step S61, it is determined whether or not the degree of confidence in determination of the presence of a road iron plate is high. If it is determined in step S61 that the degree of confidence in determination of the presence of a road iron plate is high, then the flow proceeds to step S62. If it is determined in step S61 that the degree of confidence in determination of the presence of a road iron plate is low, then the flow proceeds to step S64.

In step S62, a height of an object detected by the millimeter wave sensor 3 from a road surface is estimated, and it is then determined on the basis of the estimation in a similar manner as in step S31 of the first embodiment whether or not the object is a road iron plate. If it is determined in step S62 that the object is not a road iron plate, then the flow proceeds to step S63. If it is determined in step S62 that the object is a road iron plate, then the flow proceeds to step S64.

In step S63, it is determined that the object detected by the millimeter wave sensor 3 is a collision avoidance system activation object. In step S64, it is determined that the object detected by the millimeter wave sensor 3 is not a collision avoidance system activation object.

In the present embodiment, the height estimation unit 71 is responsible for execution of the operation in step S61. The complex environment estimation unit 72 is responsible for execution of the operations in steps S51-S53. The criterion selection unit 73 is responsible for execution of the operation in step S61. The determination unit 74 is responsible for execution of the operations in steps S63-64.

2. Some Advantages of the Object Type Determination Apparatus

The object type determination apparatus 1 of the present embodiment can provide similar advantages as in first embodiment.

3. Some Modifications

In the present embodiment, in step S51, it is determined by using the millimeter wave sensor 3 whether or not a complex environment is present forward of the controlled vehicle 101. Alternatively, it may be determined by using the image sensor 5 in a similar manner as in step S12 of the first embodiment whether or not a complex environment is present forward of the controlled vehicle 101.

It is to be understood that the invention is not to be limited to the specific embodiments disclosed above and that modifications and other embodiments are intended to be included within the scope of the appended claims. The particular features, structures, or characteristics of the first and second embodiments may be combined in any suitable manner in one or more embodiments.

In each of the first and second embodiments, it is determined whether or not the object detected by the millimeter wave sensor 3 is a road iron plate. Additionally or alternatively, it may be determined whether or not the object detected by the millimeter wave sensor 3 is an object other than a road iron plate, whose height is low enough to be passed over by the controlled vehicle 101.

In each of the first and second embodiments, it is determined whether or not the object detected by the millimeter wave sensor 3 is a vehicle. Additionally or alternatively, it may be determined whether or not the object detected by the millimeter wave sensor 3 is an object other than a vehicle, such as a pedestrian or others whose height is too high to be passed over by the controlled vehicle 101.

What is claimed is:

1. An object type determination apparatus mounted in a vehicle, comprising:

a radar sensor configured to transmit and receive radar waves to detect an object from which the radar waves are reflected;

a height estimation unit configured to estimate a height of the object detected by the radar sensor from a road surface on the basis of a variation pattern in which the intensity of a reflected wave signal varies with a distance from the vehicle to the object;

a determination unit configured to use the estimation result of the height estimation unit to determine, according to one of a plurality of predefined criteria, whether or not the object detected by the radar sensor is an object for which a collision avoidance process is performed;

a complex environment estimation unit configured to estimate a likelihood that a complex environment is present forward of the vehicle; and a criterion selection unit configured to select the one of the plurality of predefined criteria to be used by the determination unit on the basis of the estimation result of the complex environment estimation unit, the plurality of predefined criteria corresponding to different degrees of confidence in determination made by the determination unit that the object detected by the radar sensor is not an object for which the collision avoidance process is performed, the degree of confidence in determination made by the determination unit being a parameter that decreases as the likelihood that a complex environment is present forward of the vehicle increases.

2. The apparatus of claim 1, further comprising an image sensor configured to capture images of a scene in front of the vehicle, wherein the determination unit is further configured to use not only the estimation result of the height estimation unit, but also an outcome of image recognition applied to an image, from the image sensor, of a region including the object detected by the radar sensor, in determining whether or not the object detected by the radar sensor is an object for which the collision avoidance process is performed.

3. The apparatus of claim 1, wherein the complex environment estimation unit is further configured to estimate the likelihood on the basis of a floor level of a power spectrum acquired by applying frequency analysis to a beat signal that is a mixture of a transmitted radar wave signal and a received reflected radar wave signal.

4. The apparatus of claim 2, wherein the complex environment estimation unit is further configured to estimate the likelihood on the basis of an outcome of image recognition applied to an image, from the image sensor, including a region forward of the vehicle and above the road that the vehicle is traveling.

5. The apparatus of claim 1, further comprising an image sensor configured to capture images of a scene in front of the vehicle the complex environment estimation unit is further configured to:

estimate a first likelihood that a complex environment is present forward of the vehicle on the basis of a floor level of a power spectrum acquired by applying frequency analysis to a beat signal that is a mixture of a transmitted radar wave signal and a received reflected radar wave signal;

estimate a second likelihood that a complex environment is present forward of the vehicle on the basis of an outcome of image recognition applied to an image including a region forward of the vehicle and above the road that the vehicle is traveling; and estimate a third likelihood that a complex environment is present forward of the vehicle as a function of the first and second likelihoods as the estimation result of the complex environment estimation unit used by the criterion selection unit to select the one of the plurality of predefined criteria.

6. The apparatus of claim 5, wherein the complex environment estimation unit is further configured to estimate the third likelihood in at least three levels including high, medium, and low levels.

7. The apparatus of claim 1, further comprising a timing variably setting unit configured to variably set a timing at which the collision avoidance process is initiated after it is determined by the determination unit that the detected object is an object for which the collision avoidance process is performed.

8. An object type determination apparatus mounted in a vehicle, comprising:

a radar sensor configured to transmit and receive radar waves to detect an object from which the radar waves are reflected;

an image sensor configured to capture images of a scene in front of the vehicle;

a height estimation unit configured to estimate a height of the object detected by the radar sensor from a road surface on the basis of a variation pattern in which the intensity of a reflected wave signal varies with a distance from the vehicle to the object;

a determination unit configured to use the estimation result of the height estimation unit and apply image recognition to the image from the image sensor to determine, according to one of a plurality of predefined criteria, whether or not the object detected by the radar sensor is an object for which the collision avoidance process is performed;

a complex environment estimation unit configured to use the radar sensor and the image sensor to estimate a likelihood that a complex environment is present forward of the vehicle;

a criterion selection unit configured to select the one of the plurality of predefined criteria to be used by the determination unit on the basis of the estimation result of the complex environment estimation unit, the plurality of predefined criteria corresponding to different degrees of confidence in determination made by the determination unit that the object detected by the radar sensor is not an object for which the collision avoidance process is performed, the degree of confidence in determination made by the determination unit being a parameter that decreases as the likelihood that a complex environment is present forward of the vehicle increases, wherein the plurality of predefined criteria include a first criterion and a second criterion respectively corresponding to high and low degrees of confidence in determination made by the determination unit that the object detected by the radar sensor is not an object for which the collision avoidance process is performed, the determination unit is configured to, according to the first criterion selected by the criterion selection unit when it is likely that a complex environment is present forward of the vehicle, when determining from the estimation result of the height estimation unit that the height of the object from the road surface is low enough to be passed over by the vehicle and then determining from the image recognition applied to the image from the image sensor that the object detected by the radar sensor is an object whose height from the road surface is too high to be passed over by the vehicle, determine that the object detected by the radar sensor is an object for which the collision avoidance process is performed, and when determining from the estimation result of the height estimation unit that the height of the object from the road surface is low enough to be passed over by the vehicle and then determining from the image recognition applied to the image from the image sensor that the object detected by the radar sensor is an object whose height from the road surface is low enough to be passed over by the vehicle, determine that the object detected by the radar sensor is not an object for which the collision avoidance process is performed.

9. The apparatus of claim 8, wherein the determination unit is configured to, whether according to the first criterion selected by the criterion selection unit when it is likely that a complex environment is present forward of the vehicle or the second criterion selected by the criterion selection unit when it is unlikely that a complex environment is present forward of the vehicle, when determining from the estimation result of the height estimation unit that the height of the object from the road surface is low enough to be passed over by the vehicle and then determining from the image recognition applied to the image from the image sensor that the object detected by the radar sensor is an object whose height from the road surface is low enough to be passed over by the vehicle, determine that the object detected by the radar sensor is not an object for which the collision avoidance process is performed.

* * * * *